US007387526B2

(12) United States Patent
Liang et al.

(10) Patent No.: US 7,387,526 B2
(45) Date of Patent: Jun. 17, 2008

(54) ELECTRICAL CONNECTOR HAVING A LOCKING MEMBER FOR MATING WITH A MATING CONNECTOR

(75) Inventors: Shih-chieh Liang, Taoyuan (TW); Kai-hung Wang, Taoyuan (TW)

(73) Assignee: P-Two Industries Inc., Taoyuan (TW)

( * ) Notice: Subject to any disclaimer, the term of this patent is extended or adjusted under 35 U.S.C. 154(b) by 0 days.

(21) Appl. No.: 11/723,042

(22) Filed: Mar. 16, 2007

(65) Prior Publication Data

US 2007/0218759 A1 Sep. 20, 2007

(30) Foreign Application Priority Data

Mar. 17, 2006 (TW) ..... 95204457 U

(51) Int. Cl.
*H01R 13/627* (2006.01)

(52) U.S. Cl. ..... 439/353; 439/358

(58) Field of Classification Search ..... 439/595, 439/571, 572, 607, 353, 357–358
See application file for complete search history.

(56) References Cited

U.S. PATENT DOCUMENTS 5,073,130 A * 12/1991 Nakamura ..... 439/607
5,118,306 A * 6/1992 Bixler et al. ..... 439/405
6,146,205 A * 11/2000 Lai ..... 439/610
6,413,112 B2 * 7/2002 Semmeling et al. ..... 439/358
7,241,157 B2 * 7/2007 Zhuang et al. ..... 439/188

* cited by examiner

*Primary Examiner*—Michael C Zarroli
(74) *Attorney, Agent, or Firm*—Rosenberg, Klein & Lee

(57) ABSTRACT

An electrical connector is disclosed including an insulative housing, a pair of lock strips assembled to the insulative housing, and a casing assembled to the insulative housing for retaining the lock strips. The insulative housing includes a plurality of passageways receiving a plurality of conductive terminals therein. Mounting portions are respectively integrally formed on both sides of the passageways. Each mounting portion defines a plug groove, and an abutting portion is formed in the plug groove against burden of too large force. Retention portions are formed on the mounting portions for retaining the lock strips. The lock strips are respectively inserted into the plug grooves from top to bottom. Each lock strip includes a pressing portion projecting thereon. Latch portions extend from the pressing portions and are movable to lock with or disengage from a mating connector. Thus the lock strips are reliably retained.

5 Claims, 4 Drawing Sheets

ELECTRICAL CONNECTOR HAVING A LOCKING MEMBER FOR MATING WITH A MATING CONNECTOR

BACKGROUND OF THE INVENTION

1. Field of the Invention

The present invention relates to an electrical connector, and particularly to an electrical connector which firmly mates with a mating connector.

2. Related Art

An electrical connector ordinarily mates with a mating connector by a locking member. As disclosed in T.W. Pat. No. 93116768 entitled Improved Connector Preventing from Damaging Unlock Lever, a connector generally includes an insulator and cantilevered levers on both sides of the insulator. Lock grooves are defined in a front surface of the insulator. Lever grooves are defined between the insulator and the levers for lock strips being inserted thereto. Manipulation portions extend outward from the lever grooves. The lock strips are U-shaped, each forming a conic portion and an engaging portion. An upper shell and a lower shell respectively shield an upper portion and a lower portion of the insulator, guarding the manipulation portions from damage by force in vertical direction. In lock state, the conic portions and the engaging portions of the lock strips extend outward beyond the lock grooves and lock with a mating connector. In unlock state, the manipulation portions are forced inwardly, and thereafter push the lock strips in the lever grooves, driving the conic portions and the engaging portions of the lock strips to displace inwardly to disengage from the mating connector.

In prior art, however, the insulator is very complex in structure. Two sides of the insulator need to be shaped integrally, each side respectively forming a lever, a manipulation portion, a lock groove and a lever groove, which makes manufacture process complicated. Moreover, the levers need resilient force, so partially engage with the insulator only. This tends to crack the levers during manufacture and assembly. To prevent the levers from cracking or distorting, it is necessary that the upper shell and the lower shell cover the upper portion and the lower portion of the insulator, whereas this increases manufacture cost. In addition, to prevent the lock strips from taking off openings in the levers, the lock strips move by manipulation portions of the levers rather than by directly pressing. Thus larger force is required to push the lock strips, making operation inconvenient and unsatisfactory.

SUMMARY OF THE INVENTION

An object of the present invention is to provide an electrical connector which mates with a mating connector conveniently.

Another object of the present invention is to provide an electrical connector which simplifies structure and decreases manufacture cost.

To achieve the above objects, the electrical connector according to the present invention comprises an insulative housing, a pair of lock strips, and a casing assembled to the insulative housing and retaining the lock strips. The insulative housing includes a plurality of passageways receiving a plurality of conductive terminals therein. Mounting portions are respectively integrally formed on both sides of the passageways. Each mounting portion defines a plug groove, and an abutting portion is formed in the plug groove for preventing excessive force. Retention portions are formed on the mounting portions for retaining the lock strips. The lock strips are respectively inserted into the plug grooves from top to bottom. Each lock strip includes a pressing portion projecting thereon. Pressing spaces are defined between the abutting portions and inward sides of the pressing portions when assembled. Outward sides of the lock strips abut against inward sides of the retention portions. Latch portions extend from ends of the lock strips for engaging with or disengaging from a mating connector.

DESCRIPTION OF THE PREFERRED EMBODIMENTS

Figure 1:
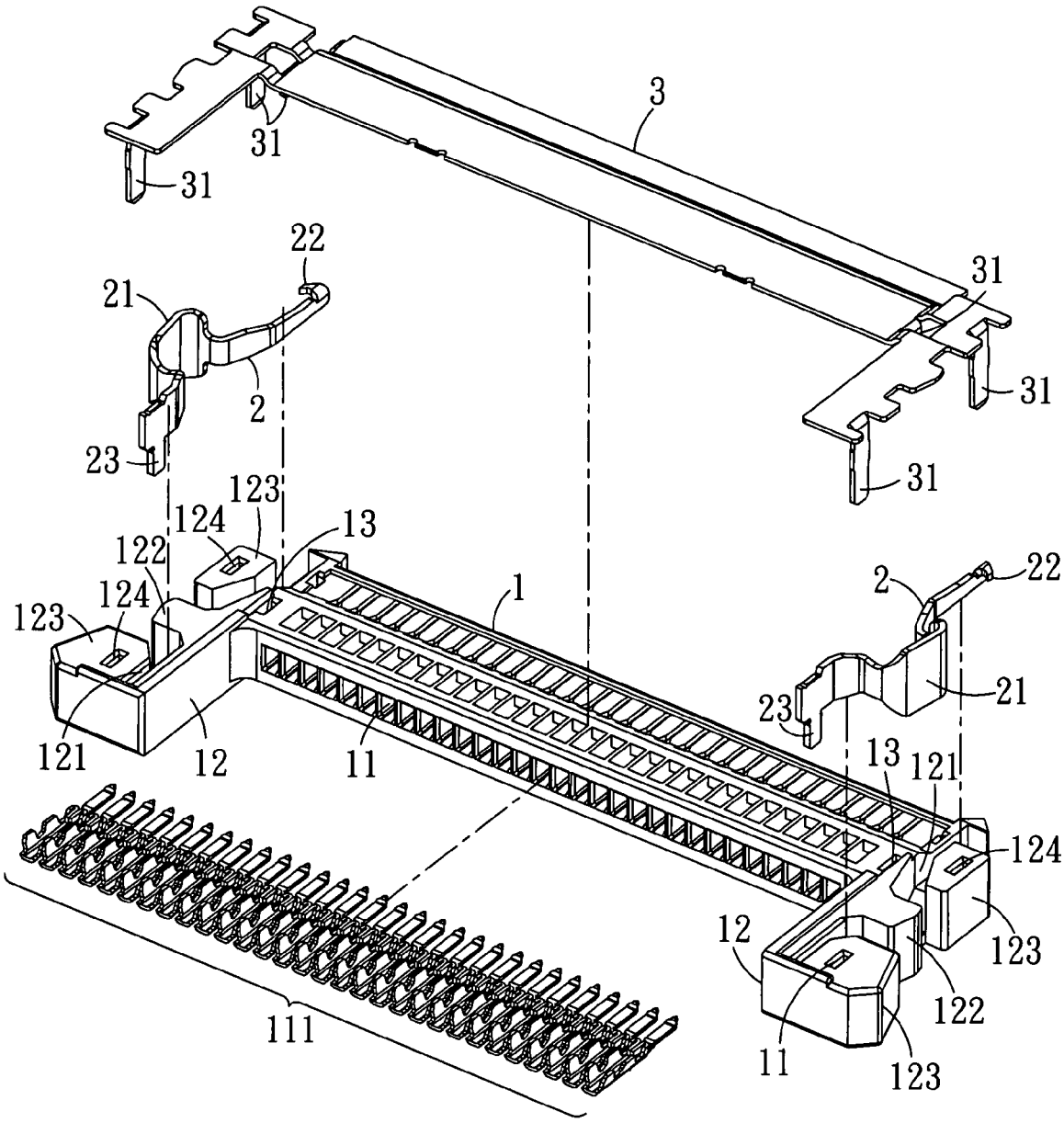
FIG. 1 is an exploded view of an electrical connector according to the present invention.
Figure 2:
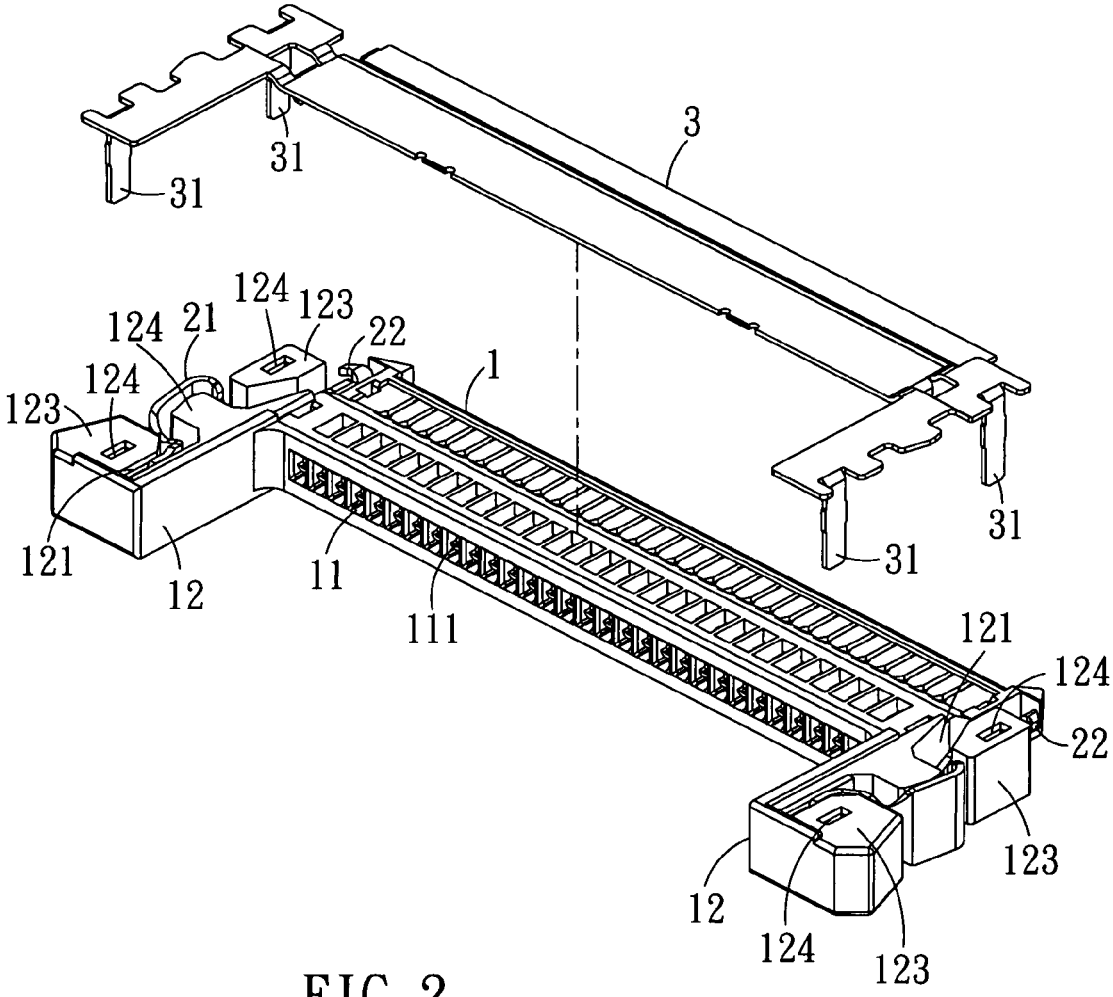
FIG. 2 is a perspective view of the electrical connector of FIG. 1, wherein a casing is disassembled from an insulative housing thereof.
Figure 3:
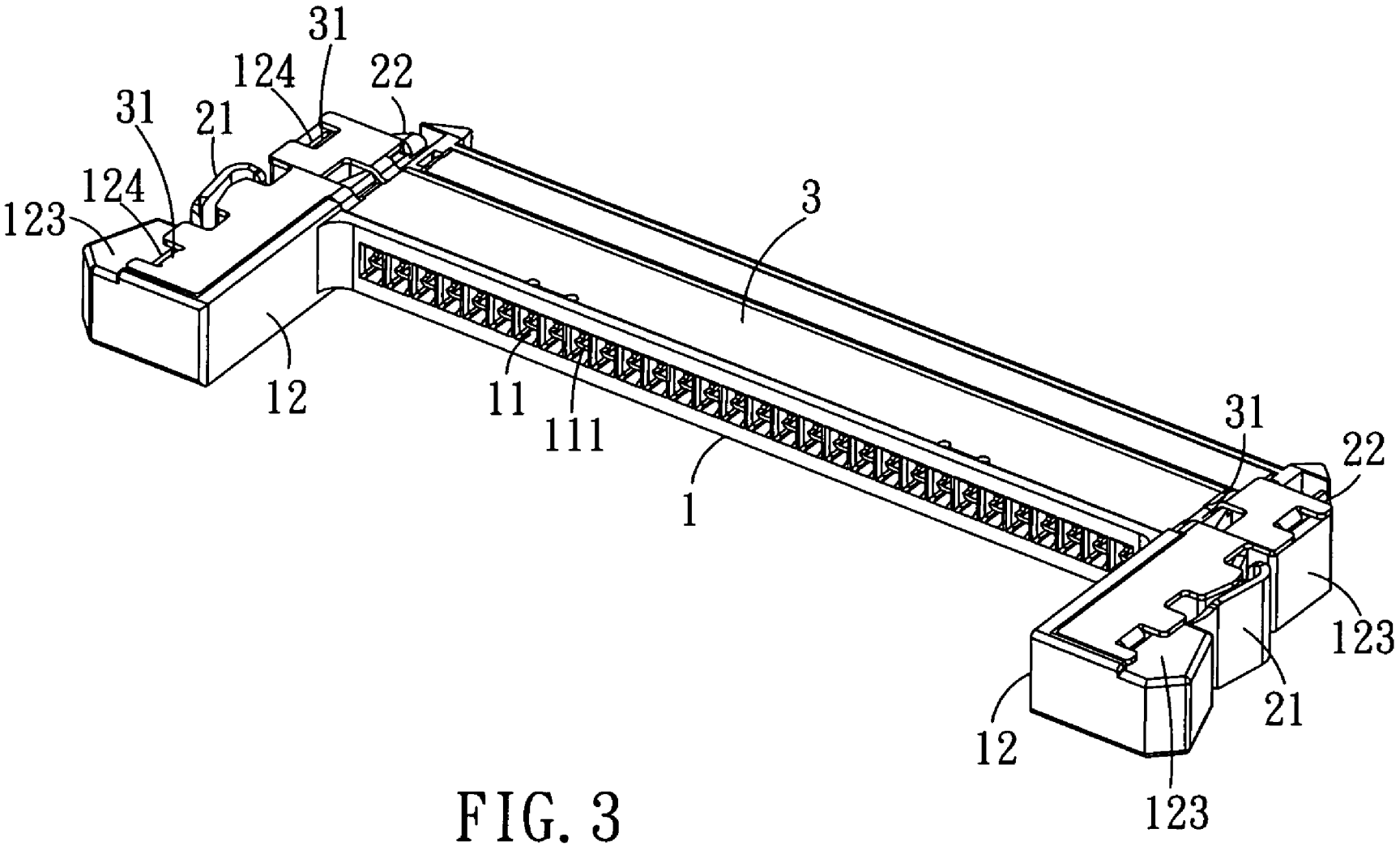
FIG. 3 is an assembled view of the electrical connector of FIG. 1.

Referring to FIGS. 1, 2 and 3, an electrical connector in accordance with the present invention comprises an insulative housing 1, a pair of lock strips 2 and a casing 3.

The insulative housing 1 comprises a plurality of passageways 11 and a plurality of conductive terminals 111 received in the passageways 11. Mounting portions 12 are respectively integrally formed on both sides of the passageways 11. Each mounting portion 12 defines a plug groove 121 for accommodating the lock strips 2. An abutting portion 122 is formed substantially in a middle of the plug groove 121. Retention portions 123 are formed on outward sides of the plug grooves 121. The retention portions 123 define through holes 124 therethrough. Positioning grooves 13 are defined at both sides of the passageways 11 and adjacent the mounting portions 12.

Each lock strip 2 has a pressing portion 21 projecting at a substantial middle thereof for being pressed by external force. A latch portion 22 integrally extends forwardly from a front end of the pressing portion 21 and is movable for locking with or disengaging from a mating connector (not shown). A tab 23 extends downward from a rear of the lock strip 2.

The casing 3 has a shape suitable to the insulative housing 1 for covering a top of the insulative housing 1 and tops of the lock strips 2. A plurality of positioning pegs 31 unitarily depend downwardly from opposing sides of the casing 3.

In assembly, the conductive terminals 111 are received in the passageways 11 of the insulative housing 1. The lock strips 2 are inserted into the plug grooves 121 of the mounting portions 12 from top to bottom. The pressing portions 21 at a substantial middle of the lock strips 2 are respectively located at outward sides of the abutting portions 122. Pressing spaces are defined between the abutting portions 122 and inward sides of the pressing portions 21. Outward sides of a front portion and a rear portion of the lock strips 2 abut against inward sides of the retention portions 123. The latch portions 22 of the lock strips 2 project outward beyond the plug grooves 121, as shown in FIG. 2. The casing 3 is assembled onto a top of the insulative housing 1 from top to bottom. The positioning pegs 31 are respectively brought to plug into the positioning grooves 13 and the through holes 124 so that the casing 3 engages with the insulative housing 1 completely, as shown in FIG. 3.

Figure 4:
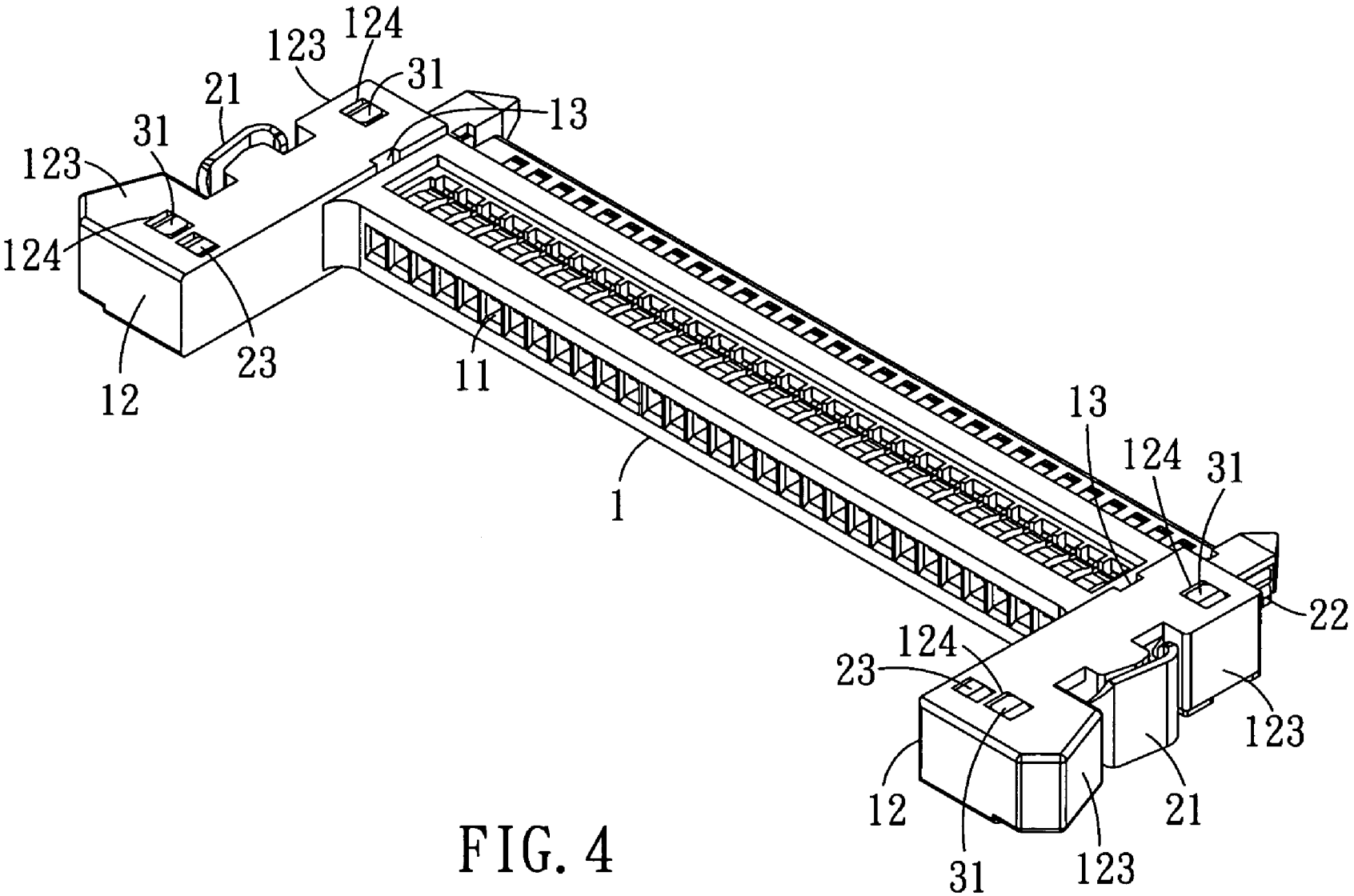
FIG. 4 is another assembled view of the electrical connector, wherein the electrical connector is upside-down.

Further referring to FIG. 4, when the positioning pegs 31 are respectively plugged into the through holes 124, distal ends of the positioning pegs 31 protrude beyond a bottom of the insulative housing 1. The distal ends of the positioning pegs 31 are bent perpendicularly so that the positioning pegs 31 bias against the bottom of the insulative housing 1. Therefore the casing 3 reliably engages with the insulative housing 1. The tabs 23 of the lock strips 2 are bent to be retained on a bottom of the mounting portions 12 of the insulative housing 1.

When the electrical connector of the present invention mates with a mating connector (not shown), the latch portions 22 of the lock strips 2 lock with the mating connector. To disengage the electrical connector from the mating connector, the pressing portions 21 are pressed by external force toward the abutting portions 122. The latch portions 22 move toward the insulative housing 1 and correspondingly depart from the mating connector.

In this embodiment, the latching portions 22 extend unitarily from the pressing portions 21. In alternative embodiments, the latching portions 22 and the pressing portions 21 may be other components integrated in all kinds of ways to achieve the functions described above. It is understood that these variations should be covered in the scope of the present invention.

Generally speaking, the electrical connector of the present invention is featured as follows:

1. The lock strips 2 are inserted into the plug grooves 121 of the mounting portions 12, simplifying assembly; the casing 3 covers a top of the insulative housing 1 and retains the lock strips 2 reliably.

2. The pressing portions 21 are fixed on outward sides of the abutting portions 122. When excessive force is exerted on the pressing portions 21, inward sides of the pressing portions 21 touch outward sides of the abutting portions 122. It is avoided that the pressing portions 21 bear large force and the lock strips 2 are spoiled.

3. The retention portions 123 are provided at outward sides of the plug grooves 121, hindering the lock strips 2 from disengaging from opposite sides of the insulative housing 1, thereby locking the lock strips 2 firmly.

4. The pressing portions 21 of the lock strips 2 are able to control displacement relative to the insulative housing 1 without need of cooperation of the insulative housing 1, simplifying the overall structure.

It is understood that the invention may be embodied in other forms without departing from the spirit thereof. Thus, the present examples and embodiments are to be considered in all respects as illustrative and not restrictive, and the invention is not to be limited to the details given herein.

The invention claimed is:

1. An electrical connector comprising:

an insulative housing including a region with a plurality of passageways receiving a plurality of conductive terminals therein, a pair of mounting portions being respectively integrally formed on both sides of this region of passageways, each mounting portion defining a pair of plug grooves formed within said mounting portion on opposing sides of an abutting portion, a pair of retention portions being formed on each of the mounting portions;

a pair of lock strips respectively inserted into the pair of plug grooves formed in each of said mounting portions from top to bottom, each lock strip including a pressing portion projecting therefrom, a pair of pressing spaces being defined between the abutting portions and inward sides of the pressing portions when assembled, wherein outward sides of the lock strips abut against inward sides of the retention potions, each of said lock strips having a latch portion extending from an end of each of the lock strips and being displaceable when a respective pressing portion is pressed; and a casing assembled to the insulative housing from top to bottom and covering tops of the lock strips.

2. The electrical connector as recited in claim 1, wherein the abutting portion is formed substantially in a middle of the plug groove, and wherein the retention portions are formed on outward sides of the plug grooves.

3. The electrical connector as recited in claim 1, wherein through holes are defined through the retention portions, and positioning grooves are defined at both sides of the passageways and adjacent the mounting portions, and wherein positioning pegs depend from the casing for plugging into the positioning grooves and the through holes.

4. The electrical connector as recited in claim 1, wherein the latch portions extend forwardly from front ends of the pressing portions for locking with a mating connector thereby retaining the insulative housing to the mating connector, the latch portions disengaging from the mating connector when the pressing portions are pressed toward the abutting portions.

5. The electrical connector as recited in claim 1, wherein tabs extend downward from rear of the lock strips and are bendable to be retained on a bottom of the insulative housing.

* * * * *